US005251748A

United States Patent [19]

Adams et al.

[11] Patent Number: 5,251,748

[45] Date of Patent: Oct. 12, 1993

[54] DUAL HALF-CARTON STRUCTURE AND METHOD OF FORMING SAME

[75] Inventors: John M. Adams, Mechanicsville; Christopher N. Chance, Richmond; James A. DeBlasio, Midlothian; Donald H. Evers, Richmond; Michael A. Kirby, Trevilians; Reginald W. Newsome, Richmond; Robert E. Talley, Chester, all of Va.

[73] Assignee: Philip Morris Incorporated, New York, N.Y.

[21] Appl. No.: 901,682

[22] Filed: Jun. 22, 1992

Related U.S. Application Data

[63] Continuation-in-part of Ser. No. 774,529, Oct. 8, 1991, Pat. No. 5,141,106.

[51] Int. Cl.[5] ..... B65D 85/10

[52] U.S. Cl. ..... 206/256; 220/23.4; 206/504

[58] Field of Search ..... 220/23.4; 206/504, 256

[56] References Cited

U.S. PATENT DOCUMENTS

| | | | |
|---|---|---|---|
| 1,805,371 | 5/1931 | Molins . | |
| 1,895,443 | 1/1933 | Brockman . | |
| 2,046,751 | 7/1936 | Reichel | 229/37 |
| 3,148,768 | 9/1964 | Gatto | 206/41 |
| 3,226,010 | 12/1965 | Rogers, Jr. | 206/256 X |
| 3,322,323 | 5/1967 | Greene et al. | 220/23.4 X |
| 4,932,534 | 6/1990 | Focke et al. | 206/602 |
| 5,029,710 | 7/1991 | Workman et al. | 220/23.4 X |
| 5,141,106 | 8/1992 | Adams et al. | 206/256 |
| 5,158,178 | 10/1992 | Cobler | 206/256 |

FOREIGN PATENT DOCUMENTS

| | | | |
|---|---|---|---|
| 255698 | 11/1927 | Italy | 220/23.4 |
| 300834 | 9/1965 | Netherlands . | |

*Primary Examiner*—William I. Price

*Attorney, Agent, or Firm*—Morey B. Wildes

[57] ABSTRACT

A method of attaching two containers wherein two containers faced toward each other are secured by co-operation of at least one tab on the front wall of one container and at least one slot on the front wall of the other container, and the dual container structure formed thereby. The slot and tab act to securely attach the two containers such that the containers may easily be separated for later sale as independent units.

13 Claims, 5 Drawing Sheets

FIG. 5
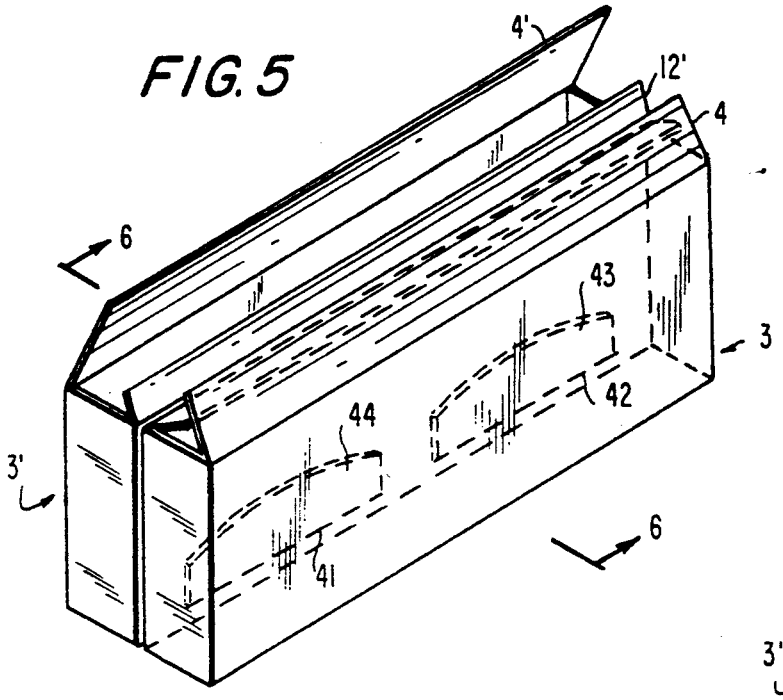
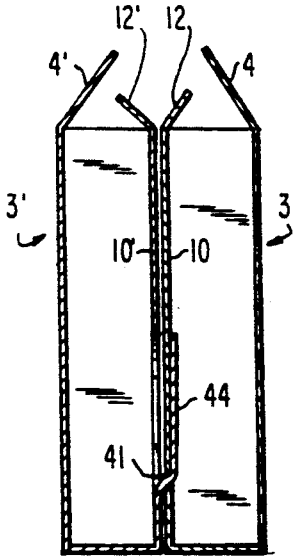
FIG. 6
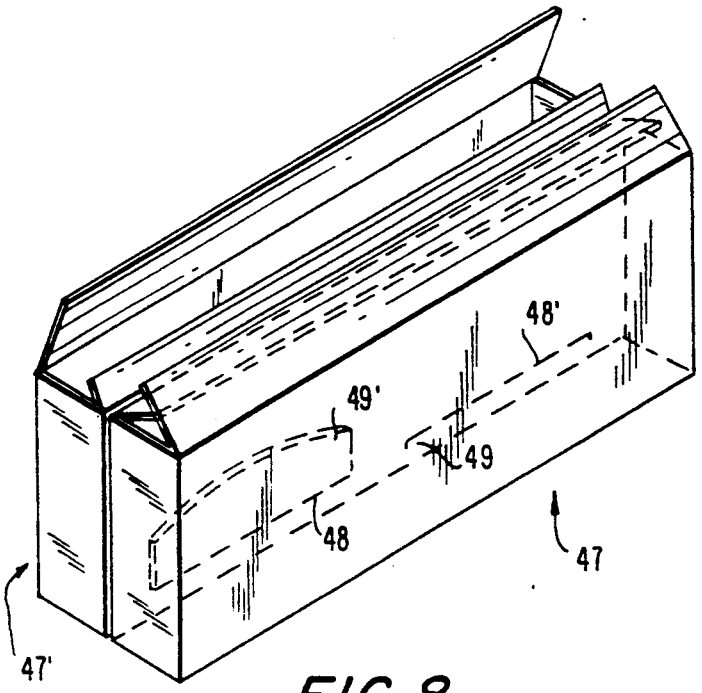
FIG. 8

DUAL HALF-CARTON STRUCTURE AND METHOD OF FORMING SAME

Cross Reference to Related Application

This application is a continuation-in-part of copending, commonly-assigned U.S. patent application No. 07/774,529, filed Oct. 8, 1991,now Pat. No 5,141,106 which is hereby incorporated by reference in its entirety.

BACKGROUND OF THE INVENTION

This invention relates to a method of attaching two half-cartons to form a dual half-carton structure. More particularly, this invention relates to a method of attaching paperboard half-cartons of cigarette packs, wherein two half-cartons may be secured together, run as a single carton through a standard tax-stamping machine and later separated for sale as individual half-carton units.

Cigarettes are commonly sold in paperboard cartons of ten cigarette packs, each pack containing about twenty to twenty-five cigarettes. Due to the rising costs of cigarettes, it has become desirable to make available to consumers half-cartons of five cigarette packs in addition to the standard ten-pack full cartons.

Standard cigarette cartons contain two parallel rows of five packs each. In each row of the carton, the five packs are typically positioned with their tops facing upward and aligned side-by-side in a 1×5 pack configuration. Two such rows form a standard 2×5 pack carton. Each 1×5 pack row may be packaged separately for sale as a five pack half-carton.

Most states and foreign countries require that tax stamps be affixed to cigarette packs prior to sale. Tax-stamping is typically done at the distributor level, after the cigarette cartons have already been filled with cigarette packs by the manufacturer, temporarily closed and shipped to the distributor. Temporarily closing the cartons may be done in many ways, such as by folding the top flaps of the cartons down over the cigarette boxes and releasably fastening the flaps in the closed position. Automated tax-stamping machines have been developed to plow open the temporarily closed cartons, apply the tax-stamps of that jurisdiction to the tops of the cigarette packs and then reseal the cartons for distribution to retail stores. Such tax-stamping machines are generally commercially available and are well known in the art.

Existing automated tax-stamping machines, however, are geared for simultaneously stamping ten cigarette packs in the standard 2×5 pack carton configuration. Accordingly, in order to use existing tax-stamping machines, separately packaged half-cartons must be configured in parallel pairs such that two half-cartons may be sent through a standard tax-stamping machine as a single 2×5 pack carton unit.

The two half-cartons must be held together securely and without slipping to ensure that the tax-stamping machine will function properly and that the two half-cartons will not be sheared apart by the tax-stamping machine. In addition, the half-cartons must be easily separable so that each half-carton may be sold by itself at the retail level.

One prior method of packaging two half-cartons for tax-stamping involved inserting two separate half-cartons into a standard 2×5 pack full carton container to facilitate tax-stamping on existing full carton tax-stamping equipment. This packaging scheme, however, was carried out primarily by hand and required significant effort at the retail level to separate the two half-cartons from the full carton container for separate sale.

Another prior method for packaging the two half-cartons for tax-stamping involved a 2×5 pack full carton that could be separated into two 1×5 pack half-cartons by tearing along a perforation. There are many variations of this perforation method, each with its own particular advantage. Still, a method that requires tearing of the half-cartons may not always work properly because separation of the two half-cartons by tearing one from the other, even along perforations, depends on the manual dexterity of the retailer or consumer doing the tearing and could result in misplaced tearing, crushing, folding or detachment of carton walls or flaps, or other deformations of the carton structure.

It is desirable to provide an improved method of packaging cigarette cartons that makes use of existing machinery for tax-stamping of cartons and requires minimal modifications of existing machinery for making half-cartons and for placing cigarette packs into them.

It is also desirable to provide an improved method of packaging two half-cartons of cigarettes so that they may be securely paired together for tax-stamping in a standard tax-stamping machine and later may be easily separated at the retail level to enable the consumer to purchase only a half-carton rather than a full carton.

It is further desirable to provide an improved method of packaging cigarette cartons so that two half-cartons may be cleanly separated at the retail level without crushing, folding, tearing or otherwise deforming any part of the carton.

SUMMARY OF THE INVENTION

It is an object of this invention to provide an improved method of packaging cigarette cartons that makes use of existing machinery for tax-stamping of cartons and requires minimal modifications of machinery for making half-cartons and for placing cigarette packs into them.

It is another object of this invention to provide an improved method of packaging cigarette cartons so that two half-cartons may be held securely together for tax-stamping in a standard tax-stamping machine and later either may remain securely together or may be separated at the consumer's option at the retail level.

It is a further object of this invention to provide an improved method of packaging cigarette cartons so that two half-cartons may be cleanly separated, if desired, at the retail level without crushing, folding, tearing or otherwise deforming any part of the carton.

These and other objects of the invention are accomplished in accordance with the principles of the invention by first forming two half-carton blanks that each have certain cuts made into one of their panels and then folding the blanks into half-cartons such that the cuts form slots in the front wall of one half-carton and tabs in the front wall of the other half-carton. When the two half-cartons are positioned front to front, the slots and tabs on the front walls of the half-cartons cooperate to attach the two half-cartons to each other. In this manner, the two half-cartons are secured one to another by the slots and tabs so that the two half-cartons may pass through and be tax-stamped in existing tax-stamping machines. The two-half-cartons are then further fastened at their tops by tape or other temporary fastening means so that, later, if the consumer chooses to purchase a full carton, the two half-cartons will remain securely together as a dual half-carton unit. If the consumer chooses to purchase only a half-carton, the two half-cartons may be easily separated without crushing, folding, tearing or otherwise deforming the carton, merely by lifting one half-carton relative to the other. The lifting action will cause the tape and the slots and tabs to release their hold on the two half-cartons and allow the half-cartons to separate for sale as two half-carton units.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which:

FIG. 5 shows a top side perspective view of two attached half-cartons;

FIG. 6 shows a vertical cross-sectional view of two attached half-cartons taken along line 6—6 of FIG. 4;

FIG. 8 shows a top side perspective view of two erected half-cartons, each formed from the blank in FIG. 7, positioned parallel to one another for attachment.

DETAILED DESCRIPTION OF THE INVENTION

In the preferred embodiment of the present invention, two paperboard blanks are erected into two half-cartons in the conventional manner and placed so that their front walls abut each other. One blank has certain cuts made into one of its panels such that these cuts become slots on the front wall of the half-carton when the blank is erected into a half-carton. The other blank has different cuts forming tabs in one of its panels such that these tabs are on the front wall cf the half-carton when the blank is erected into a half-carton. When the two half-cartons are placed front to front, the slots on one and the tabs on the other will cooperate to secure the half-cartons together and prevent them from being pulled apart during tax-stamping. Although the attached half-cartons are closed and lightly fastened at their tops for transit before tax-stamping, the half-cartons may be more securely fastened to each other at their tops after tax-stamping so they may be sold as a full carton unit.

Figure 1:
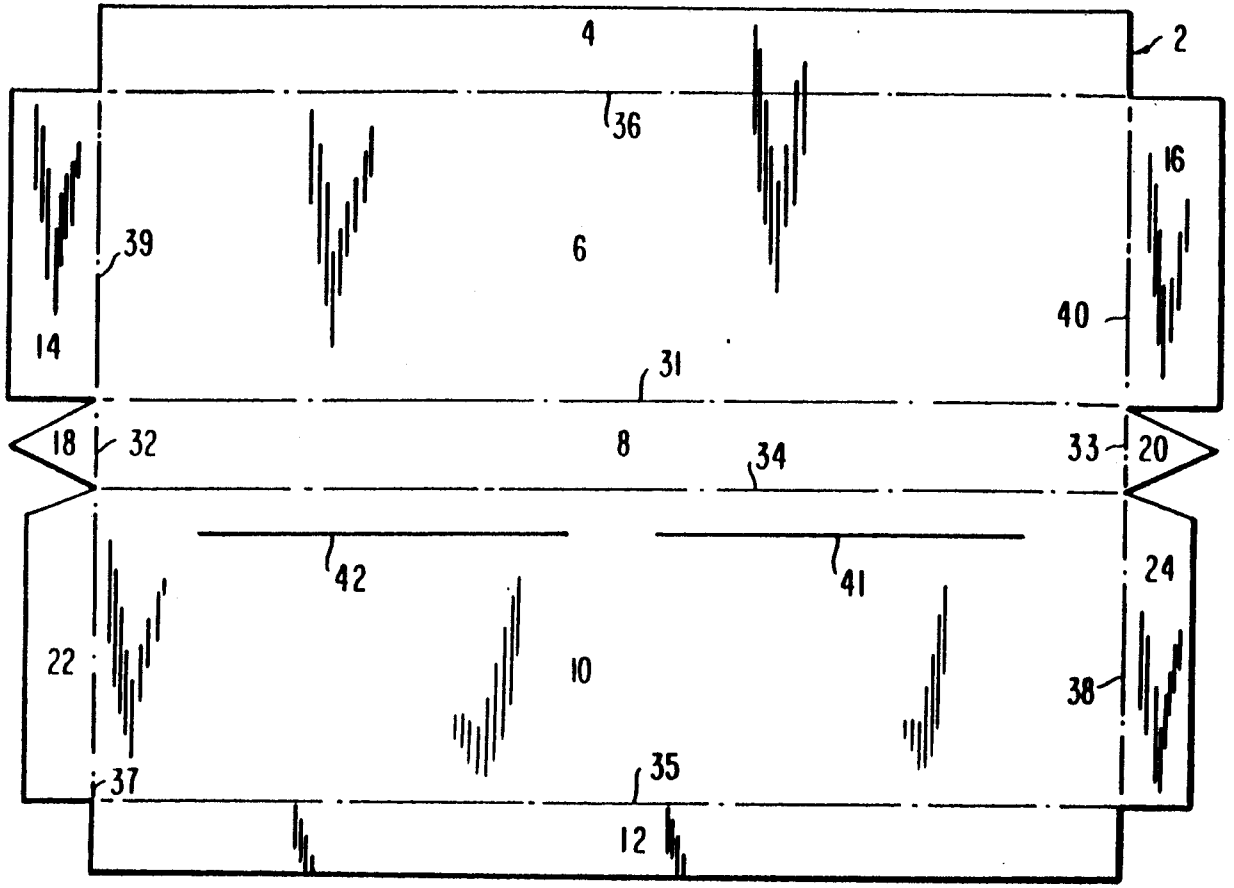
FIG. 1 shows a first blank that, when erected, forms a half-carton containing five cigarette packs aligned side-by-side and having slots in the half-carton front wall.
Figure 2:
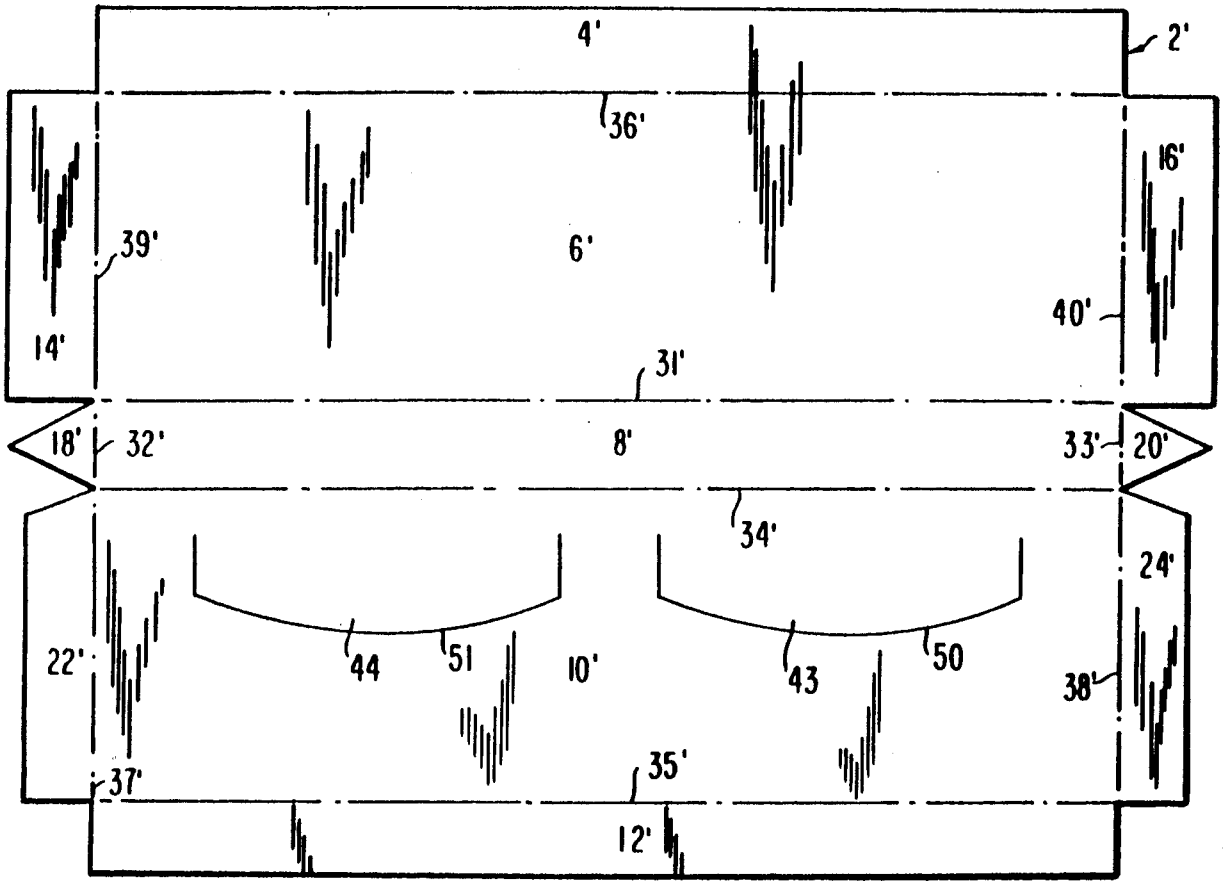
FIG. 2 shows a second blank that, when erected, forms a half-carton containing five cigarette packs aligned side-by-side and having tabs in the half-carton front wall.

In a preferred embodiment of this invention, two blanks of paperboard are fabricated as shown in FIGS. 1 and 2. Because blank 2 (in FIG. 1) and blank 2' (in FIG. 2) are almost identical, the same reference numeral will be used to identify like parts in each, except that the prime designation ("') will be used when referring to blank 2' or the half-carton formed by erecting blank 2'.

Blank 2 and blank 2' differ only in the cuts made in the respective panels of each blank that will form the respective front walls of the respective half-cartons formed from erected blanks 2 and 2'. In blank 2 in FIG. 1, at least one elongate slit 41, 42 has been cut in panel 10. In blank 2' in FIG. 2, at least one cut 50, 51 forming a widened tab 43, 44 has been cut into panel 10'.

The different panels of the blanks are separated from each other by scored fold lines, indicated in FIG. 1 by dashed lines 31–40 and in FIG. 2 by dashed lines 31'–40'. These score lines are formed by any suitable conventional means. Two half-cartons are erected by folding along the dashed fold lines of FIGS. 1 and 2.

Half-carton blank 2 is folded along the fold lines 31–40 to encase five cigarette packs aligned in the side-by-side 1×5 pack configuration. The bottoms of the five cigarette packs will rest along bottom wall 8. Back wall 6, attached top flap 4 and attached side walls 14 and 16 are folded up along fold line 3 so that back wall 6 rests against the back walls of the five cigarette packs. Bottom flaps 18 and 20 are folded up along fold lines 32 and 33 to rest against the outer side walls of the two cigarette packs at the ends of the 1×5 pack group. Front wall 10, attached top flap 12 and attached side flaps 22 and 24 are folded up along fold line 34 so that front wall 10 rests against the front walls of the five cigarette packs. Side flaps 22 ahd 24 and then side walls 14 and 16 are folded in to rest against the outer side walls of the two cigarette packs at the ends of the 1×5 pack configuration. Then, by any suitable conventional means, side walls 14 and 16 are permanently glued to bottom flaps 18 and 20 and to side flaps 22 and 24. Finally, top flaps 12 and 4 may be folded down along fold lines 35 and 36 so that they rest on the tops of the five cigarette packs. The same folding procedure is performed on blank 2'.

It will be understood that the half-carton need not actually be folded around five cigarette packs but rather may be formed hollow, such that the five cigarette packs may be inserted into the empty half-carton later, either before or after the two half-cartons are attached.

Figure 3:
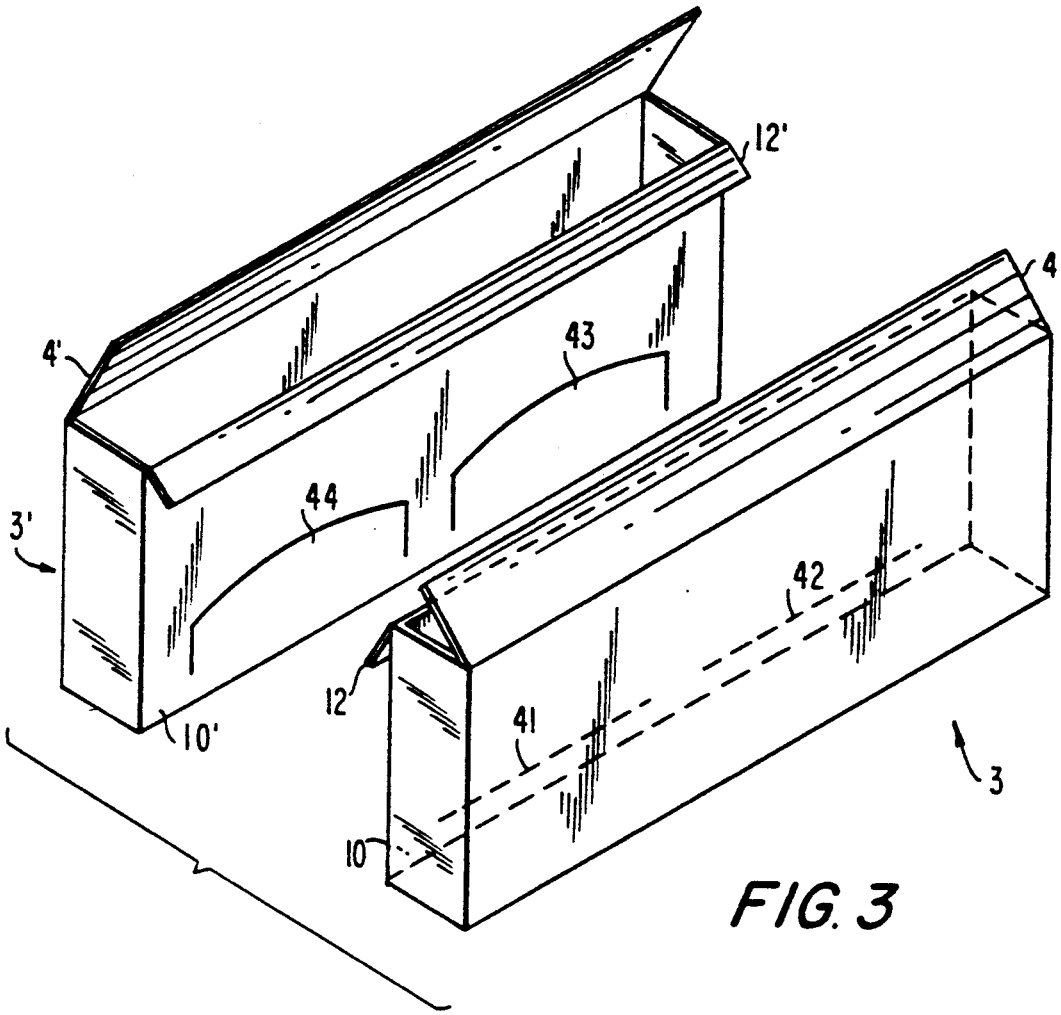
FIG. 3 shows a top side perspective view of two erected half-cartons, formed from the blanks in FIGS. 1 and 2, positioned parallel to one another for attachment.

FIG. 3 shows two half-cartons 3 and 3', formed by folding blanks 2 and 2' respectively as described earlier, positioned for attachment to each other as a dual half-carton unit. In FIG. 3, one half-carton has been rotated 180° so that front wall 10' abuts front wall 10. Top flaps 12 and 12' have been folded back away from the tops of the five cigarette packs in the half-cartons.

In the preferred embodiment of this invention, half-cartons 3 and 3' are identical in all respects except for their front walls. Front wall 10 of half-carton 3 is provided with at least one but preferably two elongated horizontal slots 41, 42 cut through front wall 10. Front wall 10' of half-carton 3' is provided with at least one but preferably two widened vertically-facing tabs 43, 44 formed in front wall 10' by cuts 50, 51. Slots 41, 42 should be wide enough to permit tabs 43, 44 to fit through them and to enter into the interior of half-carton 3 but should not be so wide such that half-cartons 3 and 3' move horizontally relative to each other when the tabs 43, 44 and slots 41, 42 are in cooperation.

Figure 4:
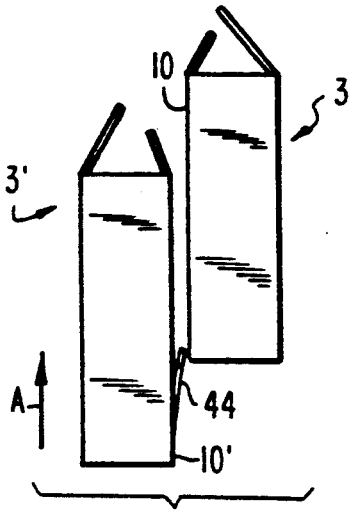
FIG. 4 shows a side elevational view of two half-cartons positioned parallel to one another for attachment with their front walls abutting each other.

To attach half-cartons 3 and 3', tabs 43, 44 on the front wall 10' of half-carton 3' and slots 41, 42 on the front wall 10 of half-carton 3 must cooperate such that the tabs 43, 44 are inserted into and through the slots 41, 42. This cooperation is accomplished by first positioning the two half-cartons 3, 3' parallel to one another so that their front walls 10, 10' abut one another and so that half-carton 3 is higher than half-carton 3', as illustrated in FIG. 4. Half-carton 3' is then moved upwards relative to half-carton 3' in the direction of arrow A in FIG. 4 in the plane of the half-carton front walls to insert tabs 43, 44 through slots 41, 42 and thus into the interior of half-carton 3.

FIG. 5 shows half-cartons 3 and 3' attached through cooperation of the tabs and the slots. The side cross-sectional view in FIG. 6 more clearly shows this cooperation by showing the tabs extending through the slots and into the interior of half-carton 3.

Figure 7:
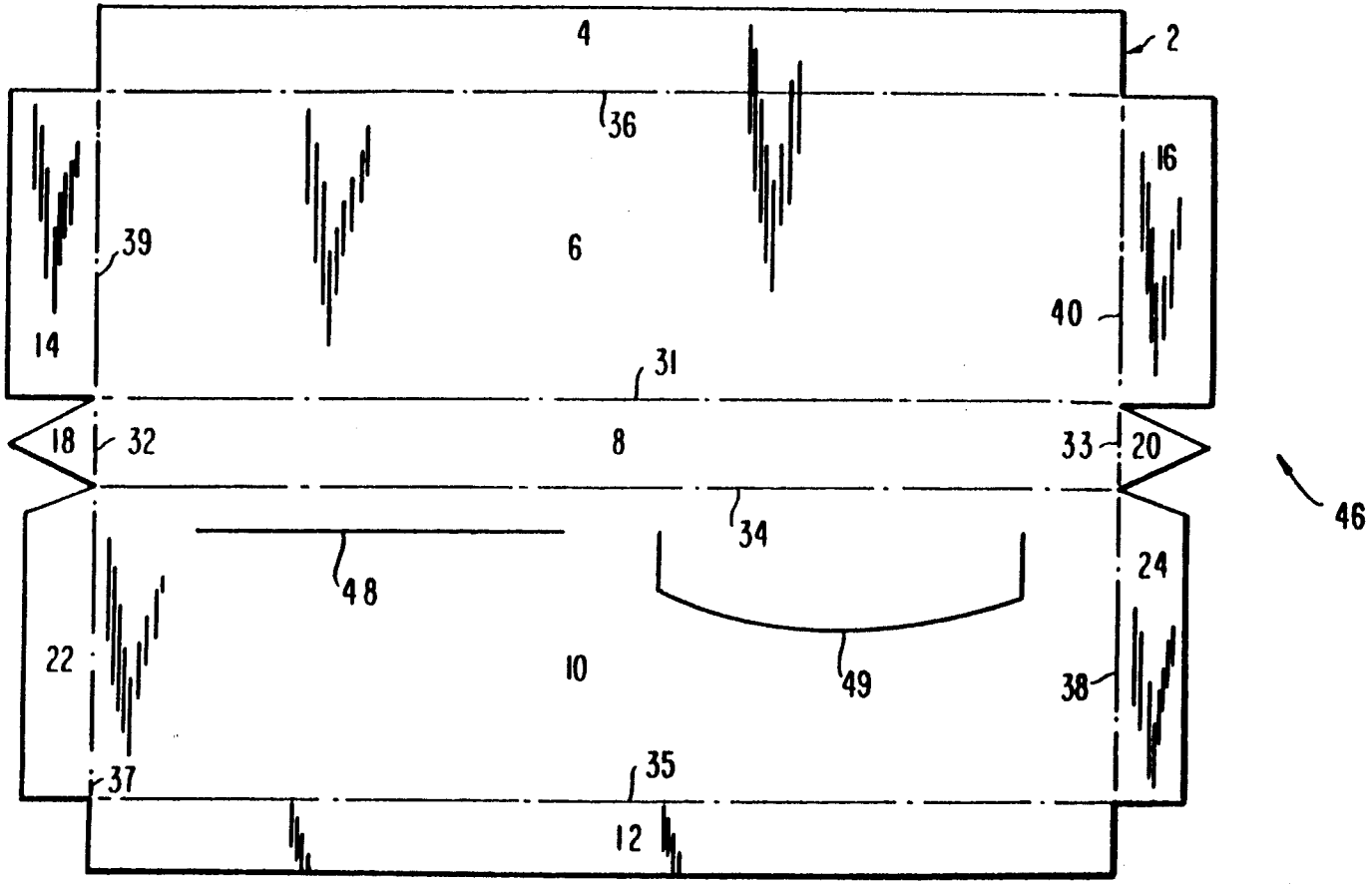
FIG. 7 shows a third blank that, when erected, forms a half-carton containing five cigarette packs aligned side-by-side and having both a slot and a tab in the half-carton front wall.

In an alternative embodiment of this invention, the two half-cartons are identical, each half-carton having on its front face both a tab and a slot. In this alternative embodiment, each half-carton is formed from an identical paperboard blank, such as blank 46 in FIG. 7. Blank 46 is identical to blanks 2 and 2' except that it has both a slot 48 and a tab 49 cut into section 10, such that when two half-cartons are formed from two blanks 46, each has a slot and a tab in its front wall. When two such half-cartons 47, 47' are aligned front to front, as illustrated in FIG. 8, the tab of each half-carton cooperates with the slot of the other half-carton. This cooperation is accomplished first by positioning the two half-cartons 47, 47' front to front and at an angle to each other such that the tab of each half-carton is slightly below the slot of the other half-carton. The two half-cartons are then turned relative to each other in the plane of the half-carton front walls such that tab 49 on half-carton 47 is inserted through slot 48+ on half-carton 47' and tab 49' on half-carton 47' is inserted through slot 48 on half-carton 47.

Although the tabs disclosed are described and depicted as widened and as preferably being two in number, the tabs may be of different number, size or shape and in different locations on the half-carton front wall, within the dimensions of the half-carton front wall from which the tabs are to be cut, depending on the design requirements, without departing from the principles of this invention. Similarly, the slots disclosed may be of such number, size and shape and in such location as to cooperate with the tabs, without departing from the principles of this invention.

When two half-cartons, each containing five cigarette packs in a 1×5 pack side-by-side configuration, are securely attached and paired together in this fashion, a full carton containing ten cigarette packs in the standard 2×5 pack carton configuration is formed. These two half-cartons may then be tax-stamped together as a single 2×5 pack unit in existing tax-stamping machines.

Typically, the half-cartons are temporarily closed and lightly fastened at their tops by the manufacturer so that the tax-stamping machine can plow open the half-carton top flaps in order to provide access to the tops of the cigarette packs for tax-stamp application. In the case where half-cartons are formed from blanks as in FIGS. 1 and 2, the tax-stamp machine must tuck top flaps 12 and 12' between half-cartons 3 and 3' before tax-stamping so that top flaps 12 and 12' will not interfere with the tax-stamp application process. The tax-stamp machine must then fold top flaps 12 and 12' back onto the tops of the cigarette packs after tax-stamping so that the half-cartons may be sealed. Another feature of the present invention is that the slots and tabs cooperate in such a manner as to operate as a hinge during the flap folding procedure. The tops of the two half-cartons may be pulled away from each other to allow the top flaps to be first tucked down and then folded back up, while the bottoms of the two half-cartons remain together due to the tabs having been inserted through the slots.

The tax-stamp machine then securely fastens the two half-cartons at their tops so that they will remain securely together during later shipping and handling. This securing together may be done with tape, releasable glue or any other temporary fastening means so that the two half-cartons may be separated later without substantial effort.

After tax stamping, at the retail level, a consumer has the option of purchasing the two half-cartons as a full ten-pack carton of cigarettes or of separating the two half-cartons and purchasing only one five-pack half-carton. If the consumer desires to purchase the entire ten-pack full carton, the two half-cartons will remain securely together due to the action of the slots and tabs. If the consumer desires to purchase only one five pack half-carton, the two half-cartons may easily and neatly be separated merely by lifting one half-carton relative to the other in the plane of the half-carton front walls. In this manner, the tabs will disengage from the slots and the releasable tape on the tops of the half-cartons will release, allowing the two half-cartons to separate completely.

Thus, a method of attaching two half-cartons, and the resulting full carton, are provided. One skilled in the art will appreciate that the present invention can be practiced by other than the described embodiments, which are presented for purposes of illustration and not of limitation, and the present invention is limited only by the claims that follow.

What is claimed is:

1. A method of attaching two containers, comprising the steps of:

forming two substantially identical containers, each container having a front wall and a top, the front wall of the first container having at least one tab formed therein and hingedly attached thereto, and the front wall of the second container having at least one slot formed therein;

positioning the two containers so that the front wall of one container abuts the front wall of the other container; and attaching the two containers by inserting the at least one tab on the first container through the at least one slot on the second container; whereby:

the tops of the two containers are capable of swinging away from each other about the place of hinged attachment; and the two containers may be detached by lifting the second container relative to the first container.

2. The method of claim 1 further comprising the step of temporarily fastening the tops of the two containers one to another.

3. The method of claim 1, wherein the step of forming two substantially identical containers comprises the steps of:

providing two substantially identical container blanks, each container blank having panels separated from each other by a scored fold line and having cuts made into one of the panels, the cuts in the panel of one of the blanks forming at least one slot and the cuts in the panel of the other blank forming at least one tab; and folding the two blanks along the score lines to form two containers, each container having a front wall, the front walls being formed by the panels having the cuts therein.

4. The method of claim 1, wherein the step of forming two substantially identical containers comprises:

providing a first container having a front wall, the front wall having at least one vertically oriented tab; and providing a second container having a front wall, the front wall possessing at least one horizontal slot having a width no less than the width of the at least one tab.

5. The method of claim 4, wherein the step of providing a second container further comprises providing a front wall possessing at least one horizontal slot having a width substantially equal to the width of the at least one tab.

6. The method of claim 1, wherein the step of forming two substantially identical containers comprises forming two substantially identical half-cartons.

7. A detachable dual container structure, comprising:

two substantially identical containers, each container having atop and a front wall, the front wall of the first container having at least one tab formed therein and hingedly attached thereto, and the front wall of the second container having at least one slit formed therein; wherein:

the two containers are positioned such that their front walls abut each other and the at least one tab on the first container is inserted through the at least one slot on the second container; whereby:

the tops of the two containers are capable of swinging away from each other about the place of hinged attachment; and the two containers may be detached by lifting the second container relative to the first container.

8. The structure of claim 7, further comprising means for temporarily fastening the tops of the containers one to another.

9. The structure of claim 7, wherein each container further comprises a top flap horizontally attached to and pivotable along the top edge of the front wall.

10. The structure of claim 7, wherein the at least one tab is vertically oriented.

11. The structure of claim 10, wherein the at least one slot is horizontal and has a width no less than the width of the at least one tab.

12. The structure of claim 11, wherein the width of the at least one slot is substantially equal to the width of the at least one tab.

13. The structure of claim 7, wherein the two substantially identical containers comprise two substantially identical half-cartons.

* * * * *